United States Patent [19]

Lewandowski

[11] Patent Number: 4,655,458

[45] Date of Patent: Apr. 7, 1987

[54] DYNAMICALLY WEIGHTED GOLF CLUB

[76] Inventor: Raymond I. Lewandowski, 2426 N. Clybourn Ave., Chicago, Ill. 60614

[21] Appl. No.: 811,832

[22] Filed: Dec. 20, 1985

[51] Int. Cl.[4] ..... A63B 53/04; A63B 53/06

[52] U.S. Cl. ..... 273/170; 273/171

[58] Field of Search ..... 273/170, 171, 169, 172, 273/168, 167 F, 167 H

[56] References Cited

U.S. PATENT DOCUMENTS

| | | | |
|---|---|---|---|
| 1,549,350 | 8/1925 | Deike | 273/186 A |
| 1,825,244 | 9/1931 | Nero | 273/170 |
| 2,214,356 | 9/1940 | Wettlauffer | 273/186 A |
| 2,396,408 | 3/1946 | Benecke | 272/84 |
| 3,172,668 | 3/1965 | Blake | 273/186 A |
| 3,199,874 | 8/1965 | Blasing | 273/170 |
| 3,215,437 | 11/1965 | Webb | 273/186 A |

*Primary Examiner*—George J. Marlo

*Attorney, Agent, or Firm*—Leydig, Voit & Mayer

[57] ABSTRACT

An improved golf club with controllable dynamic characteristics is provided with a weighting chamber of controllable weight rigidly secured within an elongated cavity defined through the head of the golf club. The chamber is dynamically weighted by providing a volume of liquid-like material such as mercury within it and has an elongated cavity defined through the cross-section of the club head. The cavity consists of a pair of interconnected cylindrical sections and is provided with a threaded set screw located in the rearward cylindrical section for varying the internal volume of the chamber so as to provide variation in its volume as well as the available displacement area for the material contained in it. The weighting chamber, when filled with the appropriate volume of material, functions to increase the head weight by a predetermined amount. When the golf club is swung downwards from the top of its back swing, the movement of the liquid-like material within the weighting chamber in the direction of swing provides added momentum which produces increased force of impact at the point where driving contact is made between the face of the club and the ball.

7 Claims, 4 Drawing Figures

DYNAMICALLY WEIGHTED GOLF CLUB

FIELD OF THE INVENTION

This invention generally relates to golf clubs, and more particularly to an improved golf club with increased head inertia and effective force of impact between the club face and the ball.

BACKGROUND OF THE INVENTION

There are many requirements for the execution of a proper golf shot. For instance, it is required that the head of the club strike the ball at that point of the golf swing where the club head velocity is the greatest and that such speed be maintained into the followthrough. Maximum force of impact between the club face and the ball is obtained only when the club meets the ball in such a manner that a plane normal to the center of the ball passes normally through the club face and the center of mass of the club head, and such contact exists when the ball is hit on the so-called "sweet spot" of the club. Further, since the driving action of the golf club is based on the laws of inertia, the weight of the club head plays a crucial role in defining the possible driving impact due to the momentum generated when the golf club is swung before hitting the ball. Thus, presuming that a player is capable of executing a proper golf shot by virtue of making a proper golf swing and contacting the ball on the "sweet spot" of the club, the player's efficiency would be considerably improved by providing a golf club capable of increased driving impact.

The increased impact force may be achieved by increasing the weight or size of the club head which in turn leads to higher head speed and momentum for impacting the ball. But the increased head size can lead to higher resistance to the swinging motion of the club and the increased head weight contributes to a higher swing weight requiring much increased effort on the part of the golfer to swing the heavier golf club properly. If the increased weight and effort is significant, it generally disrupts the golfer's swing, throws his timing off and basically results in a poor golf shot.

SUMMARY OF THE INVENTION

Accordingly, it is the primary object of this invention to provide an improved golf club with capacity for increased driving momentum without the corresponding increase in the size of the club head or a significant increase in its weight.

A related object of this invention is to provide a golf club with increased head speed for swings of a given angular velocity.

A further object is to provide a golf club with means for improving the dynamic characteristics for a given size and material of the club head.

Yet another object is to provide such an improvement means in a form which can be manufactured economically and be used conveniently in order to improve the driving characteristics of a variety of golf clubs.

Additional objects and features of the invention will be apparent from the following description in which the preferred embodiments are set forth in detail in conjunction with the accompanying drawings.

According to this invention, the above objects are realized by providing the club head with an elongated cavity adapted to receive a weighting chamber of corresponding shape. The weighting chamber is capable of holding a desired volume of a dense liquid-like material such as mercury within its confines and is placed within the elongated cavity of the club head and rigidly positioned by a face plate that covers the chamber and retains it within the head cavity. The weighting chamber is made of a light metal such as aluminum so that the additional weight factor is contributed only by the volume of liquid-like material retained within the chamber. For any given material of the club head itself, the weighting chamber when filled with the appropriate amount of liquid-like material functions to increase the head weight by a predetermined amount; the chamber thus provides a means for conveniently varying the overall weight of the club head. Because of the dynamic weighting of the club head, as the club is swung downwards from the top of its back swing, the movement of the liquid-like material within the weighting chamber in the direction of swing provides added momentum resulting in increased impact force at the point where driving contact is made between the face of the club and the ball. The advantage of such a cavity and chamber arrangement is that the weighting chamber can be economically manufactured on a large scale and then adapted to be fit into corresponding hollow sections cut out of different golf clubs, thereby permitting a variety of clubs to be improved according to the system of this invention. The desired amount of shift in the dynamic characteristics may be provided for golf clubs made of different materials by suitably adjusting the volume of the liquid-like material that is maintained within the weighting chamber. The system of this invention thus provides an easily controllable means for improving the driving impact of a variety of golf clubs relatively independent of their size, shape and material.

DESCRIPTION OF THE PREFERRED EMBODIMENTS

Figure 2:
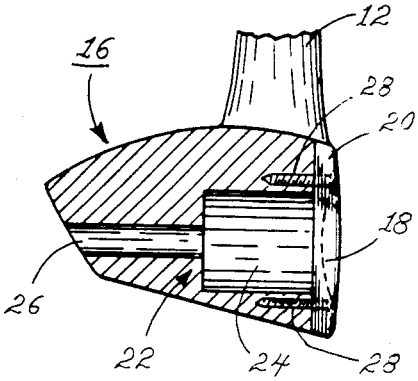
FIG. 2 is an enlarged sectional view of the club head taken along the line 2—2 of FIG. 1, illustrating the cavity within the head.

While the invention is susceptible to various modifications and alternative constructions, illustrative embodiments have been shown in the drawings and will be described below in detail. It should be understood, however, that there is no intention to limit the invention to the specific form described, but on the contrary, it is intended to cover all modifications, alternative constructions, and equivalent embodiments falling within the scope of the appended claims.

Figure 1:
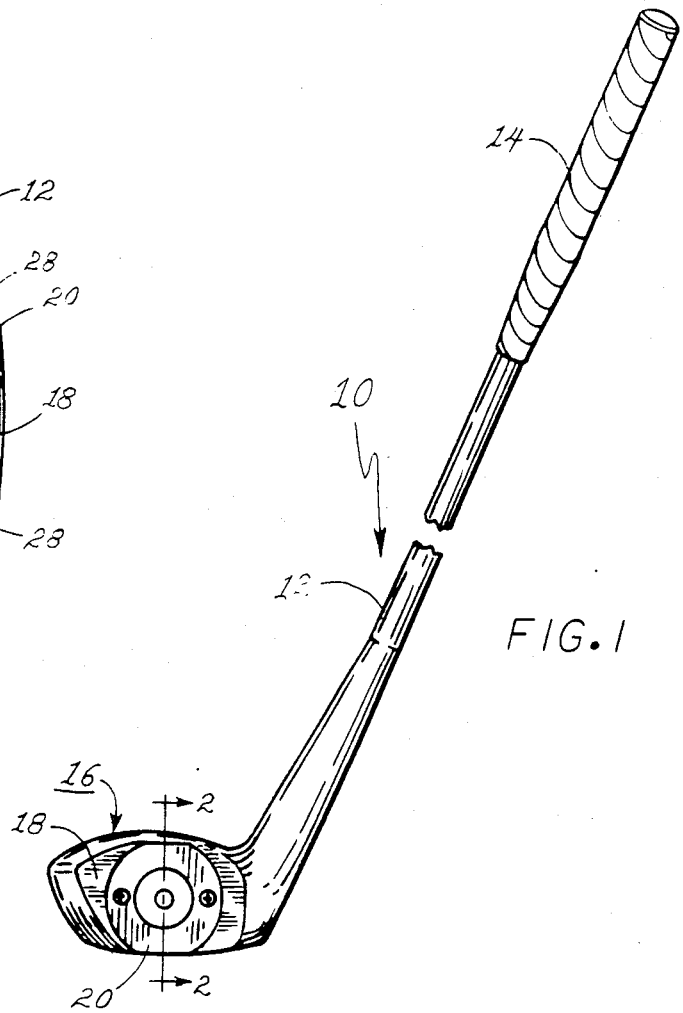
FIG. 1 is a perspective view of a golf club with an improved club head according to the system of this invention.

Referring now to FIG. 1, there is shown a perspective view of a fairly conventional "wood" type driver golf club with a modified club head according to the system of this invention. The club 10 comprises a shaft 12 having a grip or handle 14 on one end and a head 16 on the opposite end of the shaft. The club head 16 has a driving face 18 which includes a face plate 20 roughly centered about the "sweet spot" of the club head and covering an elongated cavity for holding a weighting chamber as described below.

FIG. 2 is an enlarged side cross-sectional view of the club head of the golf club shown in FIG. 1, and taken substantially along the line 2—2. As shown, the club head 16 has an elongated cavity 22 defined through the cross-section of the club head 16. The cavity 22 basically consists of two sections; a substantially cylindrical main section 24 defined at the face end of the club head and communicating with another substantially cylindrical section 26 of relatively smaller diameter but of larger length. The face plate 20 is adapted to fit over the main section 24 of the elongated cavity 22 in such a way as to define part of the contour of the club head 16. Threaded screw holes 28 are provided on the face end of the club head and are operative to receive binding screws that function to secure the face plate 20 over the main section 24 of the cavity 22 on the face end of the club head 16.

Figure 3:
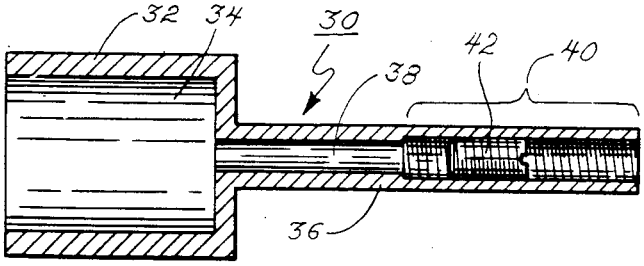
FIG. 3 is a sectional view of the weighting chamber according to the system of this invention.
Figure 4:
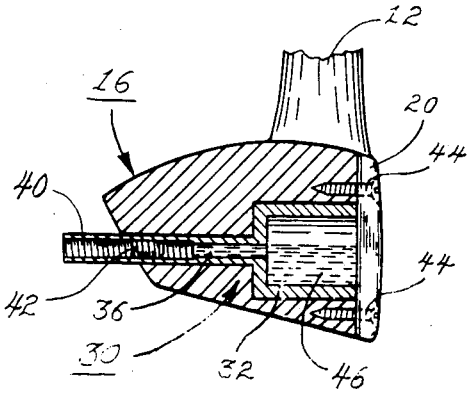
FIG. 4 is a cross-sectional view of the club head taken substantially along the line 1—1 in FIG. 1, but with the weighting chamber in position inside the head cavity.

According to this invention, the effective weight of the club head is increased by the provision of a dynamic weighting arrangement. More specifically, a weighting chamber is provided which is adapted to fit within the elongated cavity illustrated in FIG. 2. The weighting chamber is constructed basically to correspond to the shape of the two sections forming the elongated cavity within the club head and is adapted to hold a volume of heavy liquid-like material, preferably mercury, within it. The weighting chamber is also provided with means that permit control over the internal volume of the weighting chamber as well as the effective length of the weighting chamber so that the weighting chamber may be conveniently adapted for effective use with club heads of different sizes and materials. An illustrious weighting chamber of such a kind is shown in FIG. 3, which is a cross-sectional view of a weighting chamber according to this invention. As shown, the weighting chamber 30 basically comprises a substantially cylindrical main section 32 enclosing a main cavity 34. The main section 32 is in direct communication with a longitudinally extending control section 36 of substantially cylindrical shape which encloses a cylindrical cavity 38. The main section 32 is closed on its end remote to the control section 36. The control section 36 is open on its end remote to the main section 32 and has an internally threaded section 40 which is adapted to receive an externally threaded set screw 42 (FIG. 4). The length of the threaded section 40 defines the extent of movement of the set screw within the control cavity and hence the extent of variation in the effective length and the internal volume of the weighting chamber.

Referring now to FIG. 4, there is shown a cross-sectional view of the club head taken substantially along the line 2—2 in FIG. 1 and illustrating clearly the positioning of the weighting chamber within the head cavity. As shown in FIG. 4, the weighting chamber 30 is placed within the elongated cavity 22 inside the head so that the main section 32 and the control section 36 of the weighting chamber fit within the corresponding main cavity 24 and the control cavity 26, respectively, of the club head. After the weighting chamber is positioned inside the head cavity, it is rigidly secured inside the club by placing threaded screws 44 through the corresponding holes 28 defined on the face plate 20 as well as the club head 16.

As a feature of this invention, the weighting chamber is designed to be adaptable for use with club heads of a variety of shapes and sizes. More specifically, the control section 36 of the weighting chamber is designed to have a length sufficiently large to make the overall length of the weighting chamber 30 to be substantially greater than the overall width of the club head. Hence, when the weighting chamber is placed within the head cavity, a portion of the internally threaded section 40 of the control section 36 extends beyond the rear portion of the club head. With this arrangement, the placing of the weighting chamber inside the proper elongated cavity defined within the club head can be done relatively independent of the size of the head since the extending portion of the threaded portion 40 can be cut down to match the size and contour of the rear portion of a particular club head. This allows the use of a standard shaped and sized weighting chamber with club heads of varying size and shape, as long as the heads have the proper cavity defined within them.

According to this invention, the weight of the club head and hence the overall driving impact generated by the club is made easily controllable by varying the volume of the liquid-like material, in this case mercury, contained with the weighting chamber so as to change its effective weight. More specifically, and returning again to FIG. 4, after the weighting chamber has been adapted to fit within the club head it is dynamically weighted by filling it with the desired volume of liquid mercury 46 and then the set screw 42 is placed into engagement with the threaded section 40 of the control section 36. The set screw 42 thus serves to retain the mercury within the confines of the internal surfaces of the weighting chamber 30. The extent to which the set screw 42 is displaced inside the control section 36 defines the total internal volume as well as the effective length of the weighting chamber. This in turn controls the total displacement possible for the volume of mercury contained within the weighting chamber when the club is swung down from the height of the backswing for a given golf stroke. Hence, by controlling the volume of liquid mercury within the weighting chamber as well as the relative positioning of the set screw within the control section of the weighting chamber, the dynamic characteristics of the golf club may be varied in order to provide maximum driving impact between the club face and the golf ball as a result of a proper golf stroke. Although mercury is eminently suited for use with the weighting chamber because of its high density and surface tension properties, it will be understood that any such dense liquid-like material can be used for dynamically weighting the club head.

As noted above, as long as the elongated cavity 22 is defined properly within the cross-sectional area of the club head, the system of this invention is relatively insensitive to the specific size and shape of the club head. This constitutes a significant advantage as it allows golf clubs having club heads of various sizes and shapes to be easily adapted according to this invention by properly defining the elongated cavity within the club head. The weighting chamber may thus be used to increase the effective head weight, for any given material of the club head, by a predetermined amount by filling the weighting chamber with the appropriate amount of the liquid-like material.

The system of this invention provides enhanced driving momentum to the club head by virtue of the dynamically weighted weighting chamber. Specifically, the volume of the liquid-like material within the chamber is always kept significantly less than the total internal volume of the chamber itself. Under such conditions, as the club is swung downwards from the top of its backswing, the movement of the liquid-like material metal within the weighting chamber adds a significant amount of momentum and produces increased force of impact at the point where driving contact is made between the face of the club and the ball. The extent of such added momentum is defined by the relative positioning of the set screw 42 within the threaded section 40 of the control section. Precise control over the dynamic characteristics of the golf club head is thus made possible. More specifically, a club head made of a relatively lighter material may be provided with increased driving impact, for a given volume of the liquid-like material placed within the chamber, by adjusting the set screw so as to increase the total internal volume contained by the weighting chamber, thereby providing an increased area for the displacement of the liquid metal within the weighting chamber. Hence, when the golf club is swung downwards from the top of its backswing as part of a golf stroke, the liquid-like material in the chamber goes through increased displacement thereby providing increased driving impact.

It will be understood that the location of the elongated head cavity is defined in such a way that the weighting chamber is centered about the "sweet spot" of the club head. This facilitates the driving action of the golf ball by allowing it to be driven with most of the weight of the club head centered on the sweet spot and provides increased driving impact as well as "feel" for the club/ball contact. This factor, in combination with the reduced likelihood of slicing contact because of the added weight at the sweet spot, increases the overall golfing accuracy associated with the club.

The illustrious embodiment also provides increased head speed and club inertia because the weight of the club head is increased without the corresponding increase in head size. The swing weight of golf clubs, which is proportional to the weight of the club head can be conveniently controlled by varying the volume of the liquid-like material contained within the weighting chamber. The displacement area for the material within the chamber can also be easily varied to provide good control over the driving impact generated by the golf club. The above factors make the present invention particularly applicable to the customizing of golf clubs to cater to a broad spectrum of individual playing characteristics and requirements.

A major advantage of the illustrious arrangement, using a discrete weighting chamber adapted to fit within a corresponding cavity defined inside the club head, is that the weighting chamber can be economically manufactured on a large scale and then conveniently adapted to be fit into corresponding hollow sections cut out of different golf clubs, thereby permitting a variety of clubs to be adapted in order to incorporate the benefits of the system of this invention. A desired amount of shift in the driving characteristics may be economically provided for golf clubs made of different materials by suitable adjustment of the volume of the liquid-like material maintained within the weighting chamber as well as the displacement area available for the liquid metal. The system of this invention thus provides an easily controllable means for improving the dynamic characteristics and driving impact of a wide variety of golf clubs relatively independent of their size, shape and material.

I claim:

1. A golf club comprising:

a shaft having a handle at one end and a club head with a face at the opposite end;

a substantially cylindrical cavity centrally defined longitudinally through said club head perpendicular to the face;

a weighting chamber of controllable weight having a shape substantially similar to and adapted to fit within said cavity and adapted to displacably contain a selected volume of liquid-like material; said chamber including a substantially cylindrical main cavity closed at one end and communicating at the other end with one end of a substantially cylindrical control cavity, said control cavity being open on its other end and having a diameter substantially smaller and a length substantially greater than said main cavity; said chamber further including means provided at the open end of said control cavity for controllably adjusting the internal volume and length of the weighting chamber and hence the extent of possible displacement of the liquid-like material within the chamber; and means to rigidly secure said weighting chamber within the cavity in the club head.

2. The golf club as in claim 1 wherein the weight of the weighting chamber may be controlled by varying the volume of said liquid-like material within the chamber.

3. The golf club of claim 2 wherein said liquid-like material within the weighting chamber is a liquid metal such as mercury.

4. The golf club of claim 1 wherein said adjustment means is in the form of a threaded set-screw member adapted to be positioned into a corresponding threaded portion defined at said open end of the control cavity so as to seal the cavity, said member capable of being selectively positioned along the length of the control cavity so as to adjust the internal volume and length of the weighting chamber.

5. The golf club of claim 4 wherein the said weighting chamber is adapted to fit within the elongated head cavity in such a way that the closed end of said main cavity within said chamber is adjacent the face end of the club head.

6. The golf club of claim 5 wherein said securing means is in the form of a face plate adapted to be secured onto said face end of the club head so as to rigidly retain said weighting chamber within said elongated head cavity.

7. The golf club of claim 6 wherein said volume of liquid-like material is substantially less than the volume of the weighting chamber so that the movement of said liquid-like material within said chamber provides increased momentum to said club head when the club is swung during its use.

* * * * *